US009004082B2

(12) United States Patent
Bhajak et al.

(10) Patent No.: US 9,004,082 B2
(45) Date of Patent: Apr. 14, 2015

(54) DISH RACK HEIGHT ADJUSTING EMPLOYING CAM AND FOLLOWER MECHANISM

(75) Inventors: Harshal J. Bhajak, Pune (IN); Gerald J. McNerney, Stevensville, MI (US); Mihir Ponkshe, Pune (IN); Amit K. Sharma, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 1001 days.

(21) Appl. No.: 13/110,055

(22) Filed: May 18, 2011

(65) Prior Publication Data

US 2012/0291825 A1 Nov. 22, 2012

(51) Int. Cl.
*A47L 15/50* (2006.01)

(52) U.S. Cl.
CPC ..... *A47L 15/504* (2013.01)

(58) Field of Classification Search
CPC ..... A47L 15/504
USPC ..... 134/135
See application file for complete search history.

(56) References Cited

U.S. PATENT DOCUMENTS

| | | | |
|---|---|---|---|
| 2,998,290 | A | 8/1961 | Sharpe |
| 3,560,069 | A | 2/1971 | Doepke |
| 3,734,589 | A | 5/1973 | Morgan |
| 3,761,153 | A | 9/1973 | Guth |
| 3,768,883 | A | 10/1973 | Kauffman |
| 3,809,450 | A | 5/1974 | Guth |
| 3,809,451 | A | 5/1974 | Pitstick |
| 3,822,085 | A | 7/1974 | Clark |
| 3,892,453 | A | 7/1975 | Daily |
| 4,064,887 | A | 12/1977 | Geiger et al. |
| 4,097,099 | A | 6/1978 | Spiegel |
| 5,115,822 | A | 5/1992 | Nichols |
| 5,474,378 | A | 12/1995 | Smith et al. |
| 5,480,035 | A | 1/1996 | Smith |
| 5,595,200 | A | 1/1997 | Favaro |
| 5,657,878 | A | 8/1997 | Austin |
| 5,860,716 | A | 1/1999 | Good et al. |
| 5,971,513 | A | 10/1999 | Cassalia |
| 6,247,771 | B1 | 6/2001 | Miller |
| 6,571,808 | B2 | 6/2003 | Todd |
| 6,755,490 | B2 | 6/2004 | Welch et al. |
| 6,974,040 | B2 | 12/2005 | Jahrling |
| 7,032,604 | B2 | 4/2006 | Welch |
| 7,137,397 | B2 | 11/2006 | Rosenbauer et al. |
| 7,168,578 | B2 | 1/2007 | Mersch et al. |
| 7,410,228 | B2 | 8/2008 | Dickson et al. |
| 7,418,967 | B2 | 9/2008 | Kim |
| 7,424,893 | B2 | 9/2008 | Kim |

(Continued)

FOREIGN PATENT DOCUMENTS

| | | | |
|---|---|---|---|
| EP | 0788763 | A2 | 8/1997 |
| GB | 1233388 | A | 5/1971 |

(Continued)

*Primary Examiner* — Michael Barr
*Assistant Examiner* — Spencer Bell

(57) ABSTRACT

A dish rack is supported for vertical movement relative to a dishwasher tub, with the vertical adjustment being made by manually shifting the dish rack to cause a camming unit of a latching mechanism to cooperate with a follower in establishing at least a lowered position and a raised position for the rack. The camming unit includes a plurality of camming surfaces and ramps establishing multiple tiers upon which the follower is guided while being biased by a spring.

20 Claims, 10 Drawing Sheets

(56) References Cited

U.S. PATENT DOCUMENTS

| | | | | |
|---|---|---|---|---|
| 7,651,180 | B2 | 1/2010 | Deiss et al. | |
| 7,775,378 | B2 | 8/2010 | Tynes et al. | |
| 2006/0119236 | A1* | 6/2006 | Dickson et al. | 312/311 |
| 2006/0237042 | A1* | 10/2006 | Weaver et al. | 134/25.2 |
| 2007/0035220 | A1 | 2/2007 | Bond et al. | |
| 2007/0215187 | A1 | 9/2007 | Koch et al. | |
| 2008/0011337 | A1 | 1/2008 | Ryu et al. | |
| 2008/0129168 | A1 | 6/2008 | Banta et al. | |
| 2008/0272072 | A1 | 11/2008 | Tynes et al. | |
| 2009/0009040 | A1 | 1/2009 | Dellby et al. | |

FOREIGN PATENT DOCUMENTS

| | | | |
|---|---|---|---|
| JP | 4089025 | A | 3/1992 |
| KR | 100846263 | B1 | 7/2008 |
| KR | 1020090007094 | A | 1/2009 |
| WO | 0049936 | A1 | 8/2000 |
| WO | 2008038320 | A1 | 4/2008 |

* cited by examiner

DISH RACK HEIGHT ADJUSTING EMPLOYING CAM AND FOLLOWER MECHANISM

BACKGROUND OF THE INVENTION

1. Field of the Invention

The present invention pertains to the art of dishwashers and, more particularly, to a vertically adjustable dishwasher dish rack arrangement.

2. Description of the Related Art

A front loading dishwasher typically includes a tub having an open front. The tub defines a washing chamber into which items, such as kitchenware, glassware and the like, are placed to undergo a washing operation. The dishwasher is generally provided with a door, pivotally mounted to the tub, that closes the open front, and upper and lower extensible dish racks for supporting items during the washing operation. Typically, the upper and lower dish racks are separated by a defined vertical spacing that limits the overall size of items that can be placed in the dishwasher.

In order to provide more flexibility to consumers, manufacturers have developed adjustment mechanisms that enable at least one dish rack to be vertically adjustable. Most commonly, the upper dish rack can be vertically shifted to increase the defined vertical spacing between the upper and lower dish racks. Typically, the adjustment mechanisms are mounted on opposing sides of the dish rack and connect to extensible support rails that permit the dish rack to move in and out of the washing chamber. In most cases, the adjustment mechanisms have complicated structure. In addition, the latching mechanisms used by prior art adjustment mechanisms can be difficult to operate. Hidden buttons, sticky latches, and the like can make it difficult to transition from one height position to another. In some cases, the adjustment mechanisms are unstable.

Based on the above, there still exists a need in the art for a vertical height adjustment mechanism for a dishwasher dish rack. More specifically, there exists a need for a vertical height adjustment mechanism that is cost effective to manufacture and easy to use.

SUMMARY OF THE INVENTION

The present invention is generally directed to a dishwasher including a tub that defines a washing chamber and a dish rack for supporting items to be washed in the washing chamber. In accordance with the invention, the dish rack is provided with an adjustment mechanism that enables the dish rack to be vertically shifted between raised and lowered positions.

Overall, the dishwasher can take various forms, including a drawer dishwasher or a dishwasher including a door pivotally mounted relative to the tub for closing the washing chamber and the dish rack is mounted to horizontally extensible support members that permit the dish rack to be shifted in and out of the washing chamber. In either case, the adjustment mechanism includes a separate base member and a shiftable support body for sides of the dish rack. Each base member includes a lower body portion and an upright body portion, with each shiftable support body being fixed for concurrent movement to the rack and slidably receiving the upright body portion of a respective base member. In addition, the adjustment mechanism also includes a latching mechanism acting between the base member and the shiftable support body to selectively maintain the rack in a desired vertical position.

In accordance with the present invention, the latching mechanism employs a cam and spring-biased follower arrangement. In operation, a user can adjust the height of the rack by directly, manually grasping sides of the rack with his/her hands. When the rack is initially lifted, each spring-biased follower tracks the profile of a first camming surface provided along a first tier of a camming unit. At the point that the rack reaches a desired, upper raised position, the follower is automatically shifted by the force of the spring so as to extend over a ledge or plateau portion of the camming unit. Upon slightly lowering the rack, the follower rests on the ledge to support the rack in the raised position. To lower the rack, the user further lifts on the rack, allowing the follower to unseat from the ledge and engage a second camming surface provided on a second tier of the camming unit through the biasing of the spring and the presence of a ramp. From this position, the follower is guided from the second tier back against the camming surface of the first tier to assume the lowered position.

With this arrangement, a dish rack can be readily repositioned between at least upper and lower positions in an effective and reliable manner. Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
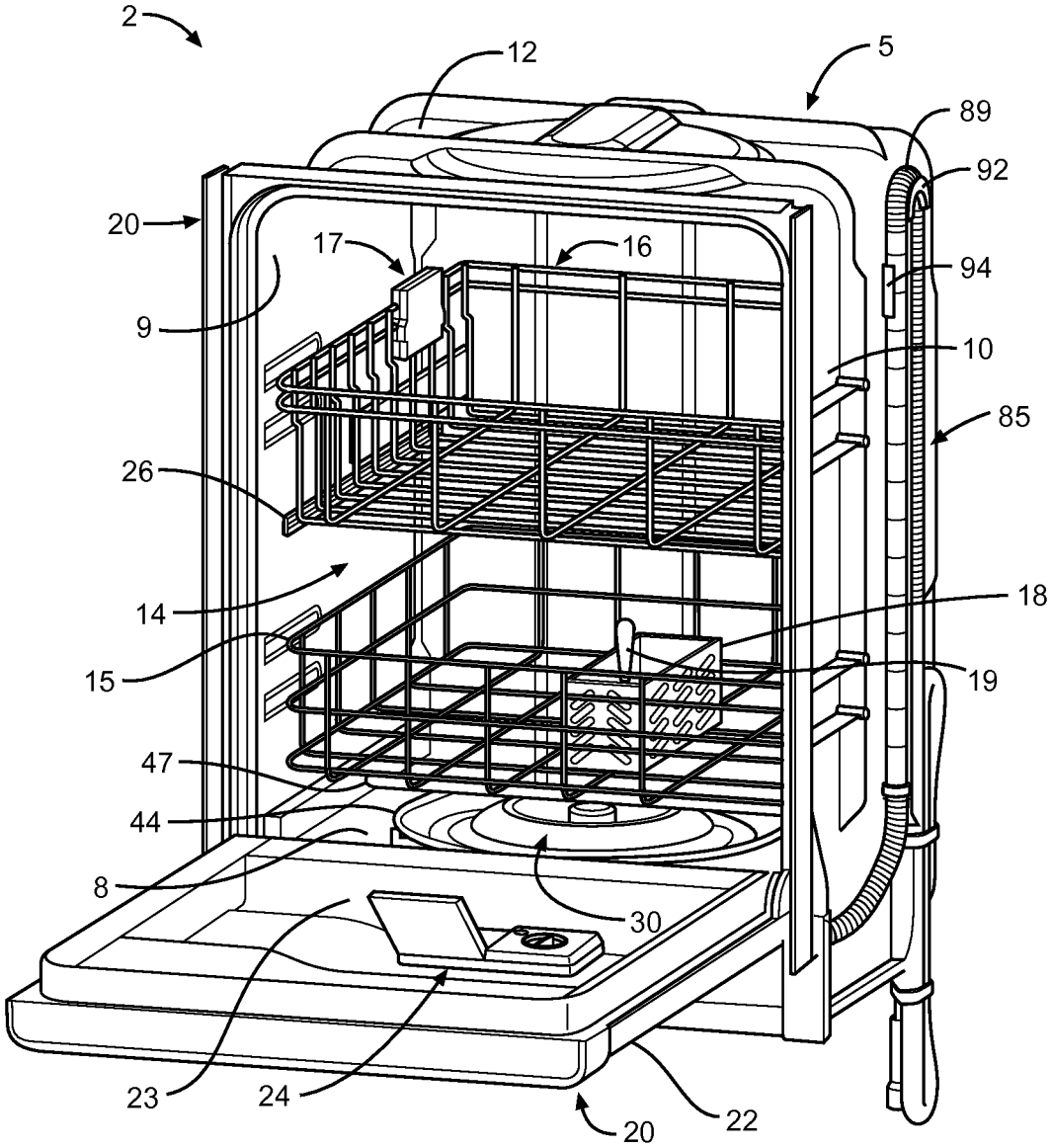
FIG. 1 is a perspective view of a dishwasher incorporating a dish rack having a vertical height adjustment mechanism constructed in accordance with the present invention.

With initial reference to FIG. 1, a dishwasher constructed in accordance with the present invention is generally indicated at 2. As shown, dishwasher 2 includes a tub 5, which is preferably injection molded of plastic, so as to include integral bottom, side, rear and top walls 8-12 respectively. Within the confines of walls 8-12, tub 5 defines a washing chamber 14 within which soiled kitchenware is adapted to be placed on a lower dish rack 15 and/or an adjustable upper dish rack 16 which, as will be detailed more fully below, includes an adjustment mechanism 17 for vertically shifting dish rack 16 between a first or home position and a second or raised position. As shown in this figure, a utensil basket 18, which contains a utensil 19, is preferably positioned within lower rack 15. Tub 5 has associated therewith a frontal portion 20 at which is pivotally supported a door 21 used to seal washing chamber 14 during a washing operation. Door 21 has an exterior panel 22 and an interior panel 23 preferably provided with a dispensing assembly 24 within which a consumer can place liquid or particulate washing detergent for dispensing at predetermined periods of the washing operation.

In a manner known in the art, upper dish rack 16 is horizontally shiftable between a first position wherein upper dish rack 16 is entirely within the confines of washing chamber 14 and a second position, wherein upper dish rack 16 extends, at least partially outward, from washing chamber 14. Toward that end, dishwasher 2 is provided with extensible support members, one of which is indicated generally at 26. In a similar manner, lower dish rack 15 is selectively, horizontally shiftable between first and second positions. However, when in the second position, lower dish rack 15 rests upon an open door 21 on guide elements (not separately labeled) formed on interior panel 23.

Disposed within tub 5 and, more specifically, mounted within a central opening formed in bottom wall 8 of tub 5, is a pump and filter assembly 30. Extending about a substantial portion of pump and filter assembly 30, at a position raised above bottom wall 8, is a heating element 44. In a manner known in the art, heating element 44 preferably takes the form of a sheathed, electric resistance-type heating element. In general, pump and filter assembly 30 is adapted to direct washing fluid to a lower wash arm 47 and an upper wash arm (not shown). Dishwasher 2 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In any event, in this manner, an upper loop is maintained in drain hose 85 to assure proper drainage in a manner known in the art. As the exact structure and operation of pump and filter assembly 30 of dishwasher 2 is not part of the present invention, it will not be discussed further herein. Instead, the present invention is directed to particulars of height adjustment mechanism 17. However, at this point it should be noted that the invention can be employed in connection with adjusting the height of dish racks in various types of dishwashers, including the more conventional type shown in FIG. 1 and drawer dishwashers.

Figure 2:
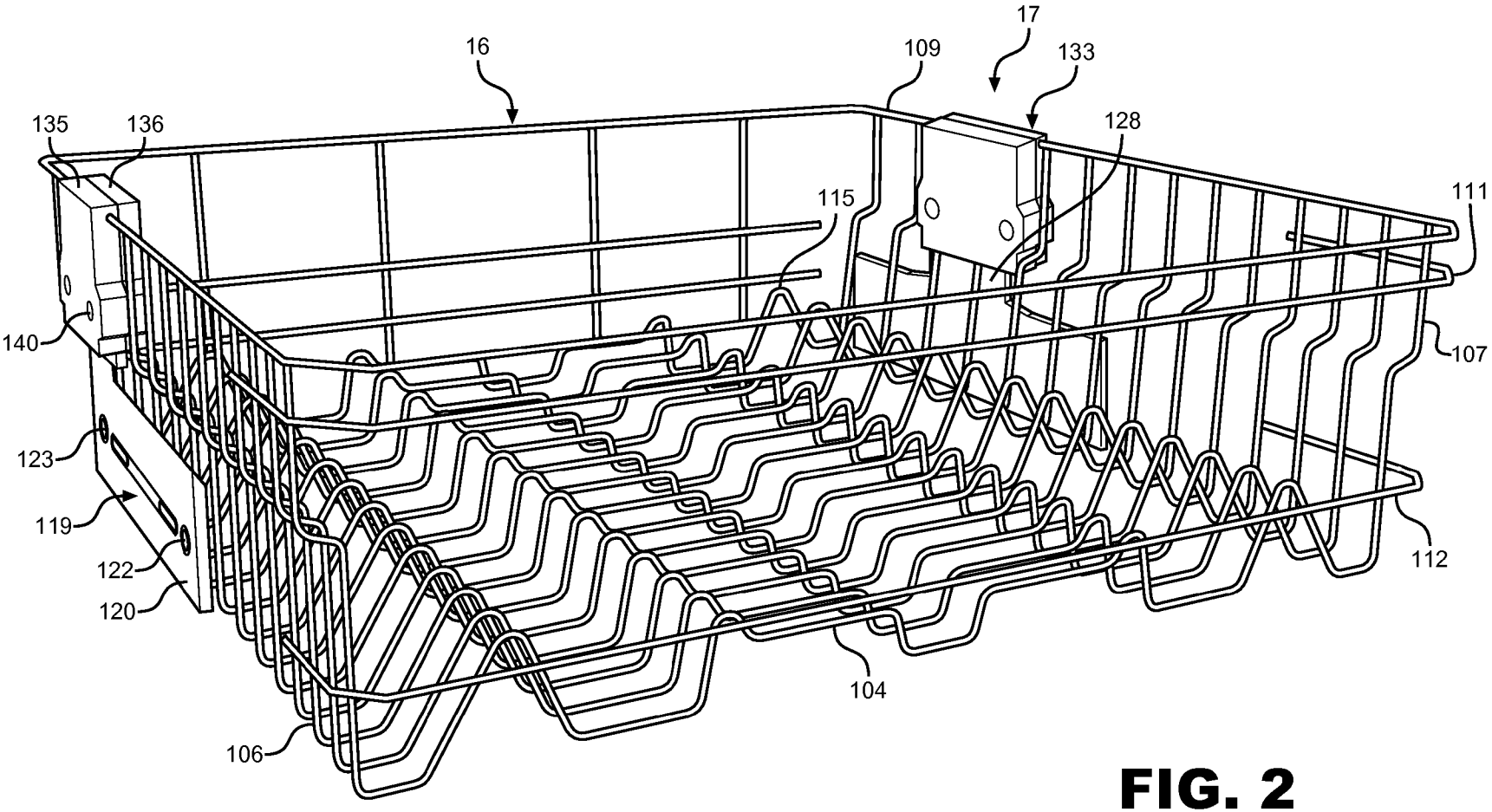
FIG. 2 is a perspective view of the dish rack with the height adjustment mechanism from the dishwasher of FIG. 1.
Figure 3:
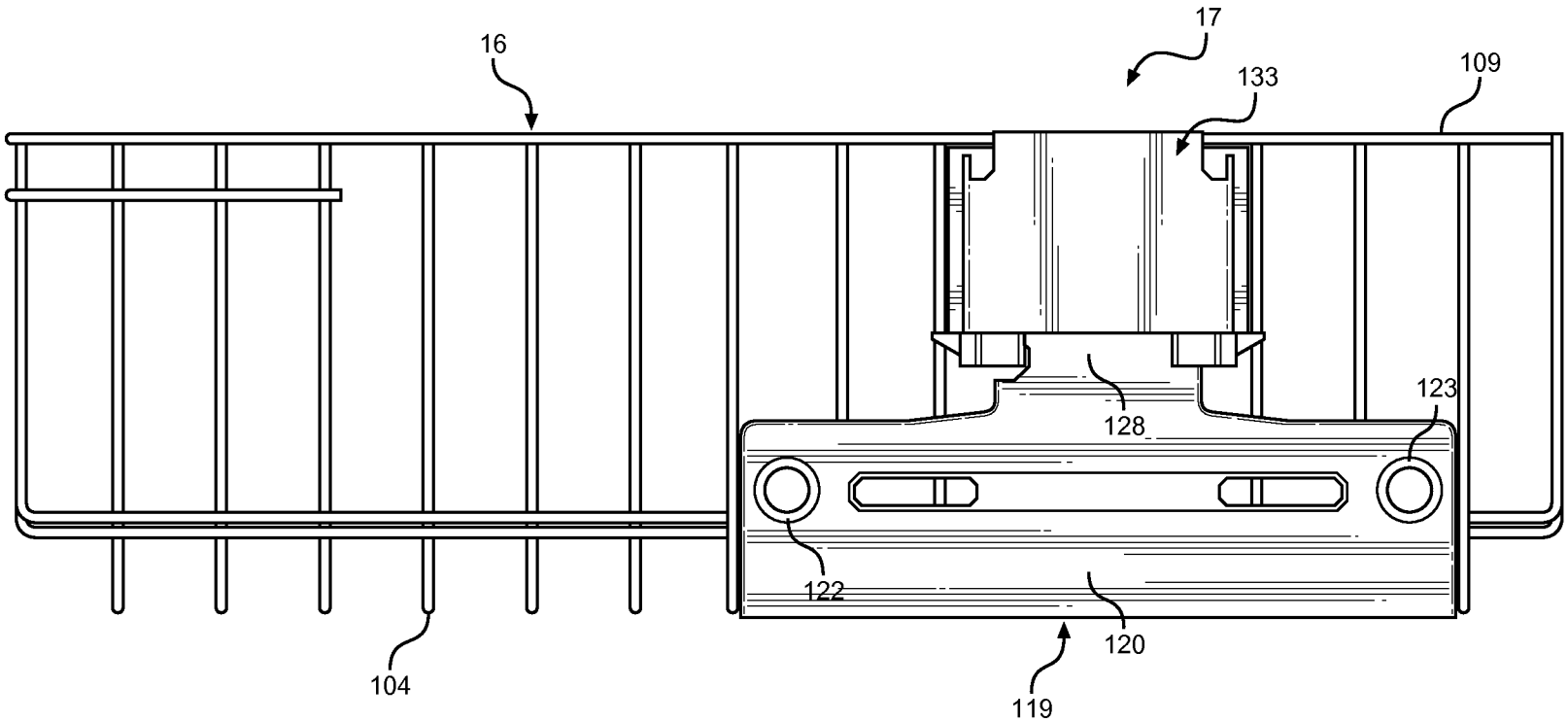
FIG. 3 is an elevational side view of the rack with the height adjustment mechanism of FIG. 2.

Reference will now be made to FIGS. 2 and 3 in describing the particular details of height adjustment mechanism 17 and its connection to rack 16. In either case, in the exemplary embodiment shown, rack 16 is formed of interconnected wires so as to define a plurality of bottom rails 104 which extend up and define opposing side rails 106, 107. Also shown is an upper peripheral rim rail 109 and a plurality of lower peripheral rails 111, 112. Bottom rails 104 have portions thereof which define multiple levels for rack 16 and are formed with various raised rail portions, such as that indicated at 115, to more readily support various kitchenware items in a manner known in the art. In general, the particular construction and design of rack 16 can greatly vary in accordance with the invention and is known in the art. At this point, it is simply important to note that rack 16 includes bottom, side, rear and front walls (not separately labeled).

Height adjusting mechanism 17 of the invention is shown to include a base member 119 having a lower body portion 120. In connection with the embodiment shown wherein rack 16 is also mounted for sliding movement relative to tub 5, lower body portion 120 includes mounts 122 and 123 for rotatably supporting a pair of fore-aft-spaced wheels (not shown) which interact with support members 26 carried by tub 5 in order to enable rack 16 to be shifted into and out of washing chamber 14 in a manner widely known in the art. Base member 119 also includes an upright or upper body portion 128 which is received within a shiftable support body 133. More specifically, shiftable support body 133 includes an outer body 135 and an inner body member 136 which combine to clamp upon a respective set of side rails 106, 107 and which are secured together by screws indicated at 140. At this point, it should be recognized that a separate base member 119 and shiftable support body 133 are provided on each of side rails 106, 107 such that the overall height adjustment mechanism 117 can be readily understood from considering the structure and function of one side.

With this arrangement, it should be realized that the interengagement between each base member 119 with a respective support member 26 prevents base member 119 from shifting vertically relative to tub 5, while still enabling each base member 119 to move into and out of washing chamber 14. In the case of a drawer dishwasher, base member 119 would simply be fixed, with upright body portion 128 projecting upwardly inside the tub. In any case, the clamping or sandwiching of side rails 106, 107 by the shiftable support bodies 133 enables rack 16 and the shiftable support bodies 133 to move vertically relative to base members 119. Since the upright body portion 128 of each base member 119 extends within a respective shiftable support body 133, each support body 133 is guided for vertical movement relative to its base member 119.

In accordance with the present invention, the particular number of vertical positions which can be established by rack 16 can vary greatly. In its simplest form, the invention contemplates just upper and lower positions, with the lower position being represented in FIGS. 2 and 3 wherein each shiftable support body is bottomed out on a corresponding upper body portion 128 of base member 119 as detailed more fully below. More importantly, it is desired in accordance with the present invention to provide a latching mechanism to maintain rack 16 in a desired raised position as will now be described with reference to the preferred embodiment shown in FIGS. 4-10.

Figure 4:
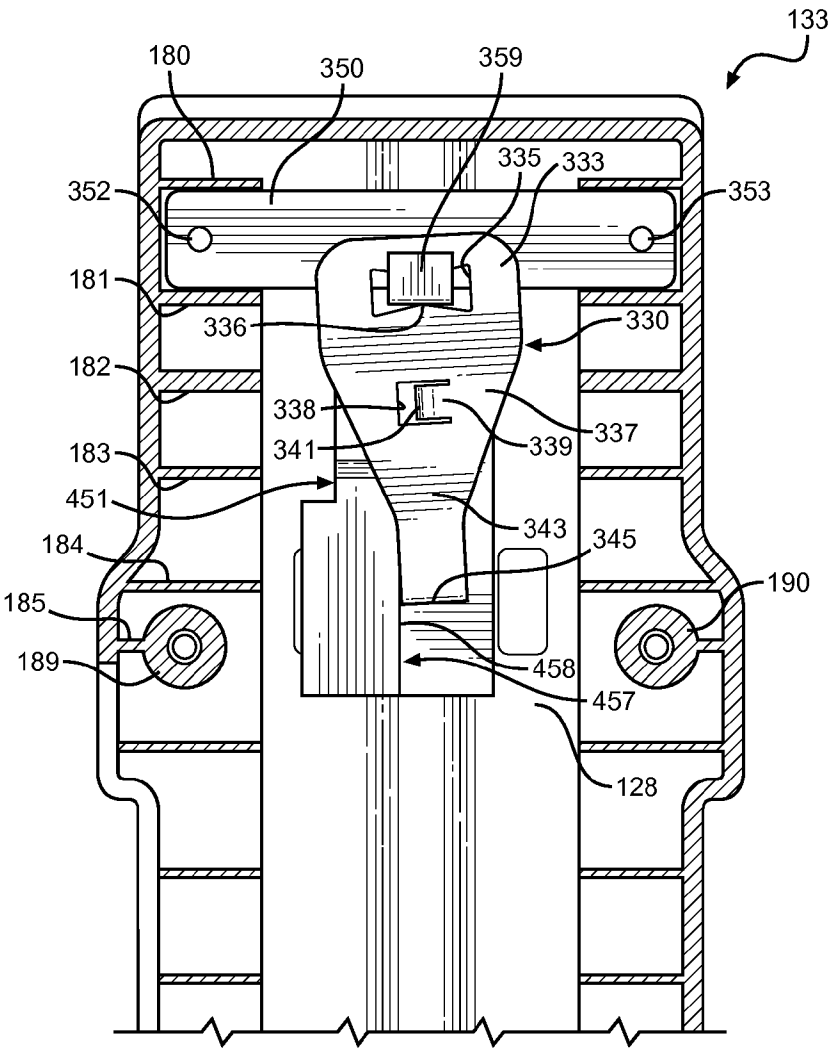
FIG. 4 is a cross-sectional view of a height adjustment mechanism with a latching mechanism constructed in accordance with the invention.
Figure 5:
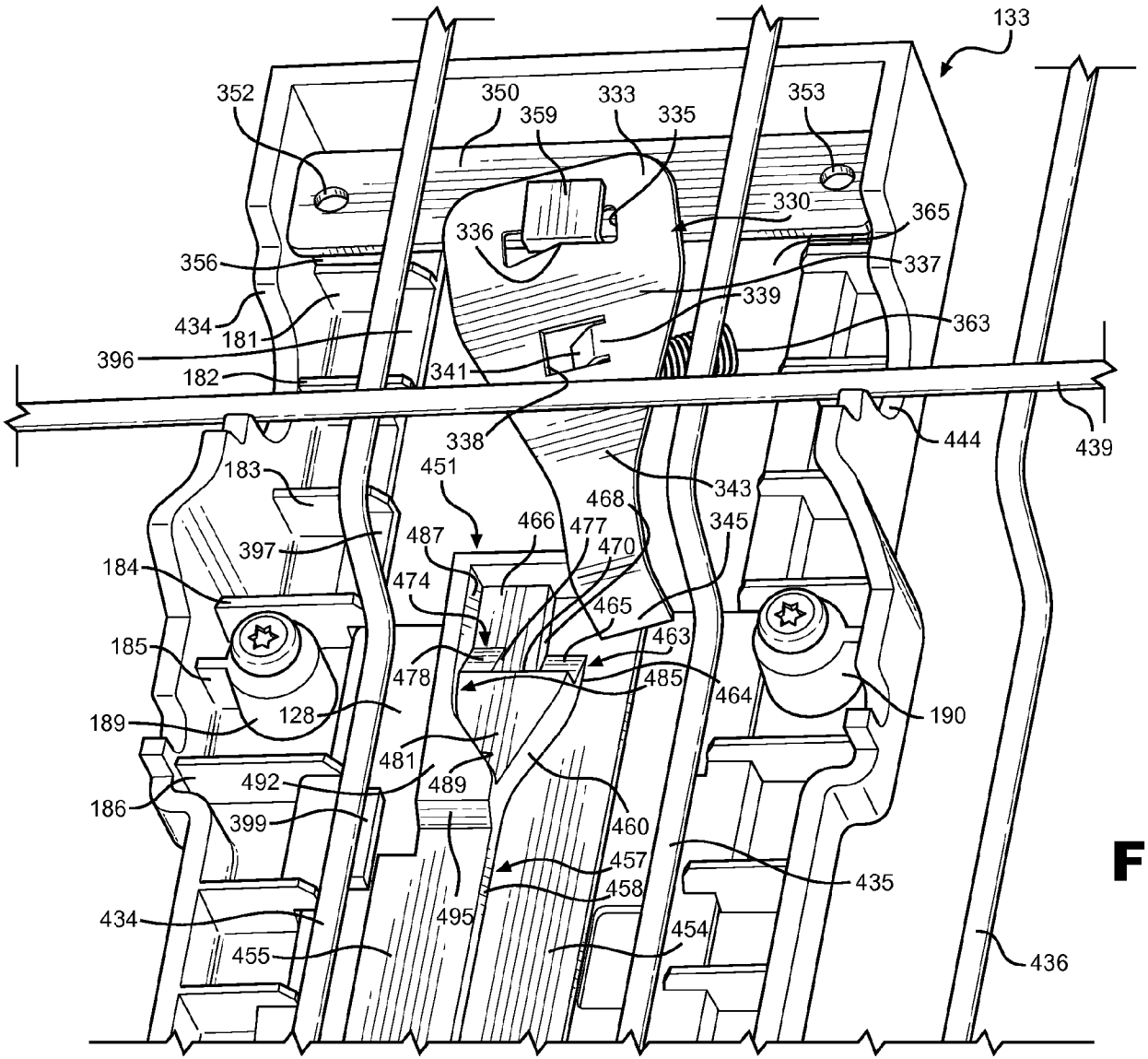
FIG. 5 is a perspective view of the height and latching mechanisms of FIG. 4.

With initial reference to FIGS. 4 and 5, according to this embodiment, the latching mechanism includes a retainer element 330 in the form of a shiftable plate. Retainer element 330 includes an upper section 333 provided with an opening 335 that is depicted as being generally bowtie-shaped so as to define a fulcrum 336. Retainer element 330 also includes an intermediate section 337 having a cut-out 338 into which projects a flange 339 having a terminal bent portion 341. Finally, retainer element 330 includes a tapered section 343 leading to an in-turned terminal end portion 345 which defines a follower. A mounting plate 350 is provided with a pair of spaced apertures 352 and 353 for securing mounting plate 350 to respective posts, one of which is indicated at 356 in FIG. 5, of shiftable support body 133 through the use of mechanical fasteners (not shown). Mounting plate 350 is provided with a central support member 359 that generally takes the form of a hook. As shown, central support member 359 projects through upper opening 335 of retainer element 330 such that retainer element 330 can pivot relative to mounting plate 350 along fulcrum 336. In addition, as will be detailed more fully below, retainer element 330 can shift upon support member 359 orthogonal to an axis of pivoting, i.e., in and out of the pages of these figures. To control the movement of retainer element 330, the latching mechanism also includes a spring 363 (see FIG. 5) which extends between a wall portion 365 of support body 133 and terminal bent portion 341 of flange 339. In general, spring 363 continually biases retainer element 330 to rotate in a clockwise direction while pushing retainer element 330 toward wall portion 365 as will become more fully evident below.

At this point, it should be recognized that shiftable support body 133 in accordance with this embodiment is generally constructed identical to that described above, with the inclusion of various ribs 180-186 and screw posts 189 and 190, and is mounted about upright body portion 128 for relative vertical sliding movement. With the perspective view of FIG. 5, additional details of support body 133 are illustrated. In particular, it will be noted that support body 133 is provided with various spaced lip defining members 396 and 397, as well as tab members 399, which are adapted to extend about edge portions (not separately labeled) on opposing sides of upright body portion 128 in order to slidably guide support body 133. In addition, this figure illustrates three upright side rails 434-436 of upper dish rack 16, as well as a portion of a cross rail 439 that interconnects upright rails 434-436. More specifically, upright rails 434 and 435 are sandwiched between outer body 135 and inner body member 136 of support body 133, while cross rail 439 extends entirely through support body 133 due to the presence of side openings 443 and 444. At this point, it should be understood that support body 133 could be attached to upper dish rack 16 in various ways and it is only important to note that upper dish rack 16 and support body 133 are vertically shiftable in unison in accordance with all of the disclosed embodiments. In accordance with this embodiment, it is the particular latching arrangement which is important to the present invention, as will now be described in detail.

Either attached to or formed as part of upright body portion 128 is a camming unit 451. Like upright body portion 128, camming unit 451 is vertically fixed such that it does not move vertically with upper dish rack 16 and support body 133, but can still shift into and out of washing chamber 14 with upper dish rack 16. As perhaps best shown in FIG. 5, camming unit 451 includes a first base portion 454 and a second base portion 455 which are offset by a first abutment wall 457. First abutment wall 457 establishes a first camming surface 458 including a flared portion 460. At the uppermost region of flared portion 460, camming unit 451 is provided with a first ramp 463 defined by a tapered side wall 464 and a ramp surface 465. Adjacent first ramp 463 is a first platform 466. Interposed between ramp surface 465 and first platform 466 is a second abutment wall 468. Projecting from first platform 466 is a ledge or plateau 470. With this arrangement, first ramp 463 leads from first base portion 454 to ledge 470. Provided along ledge 470 is a second ramp 474, including a tapered side wall 477 and a ramp surface 478. Second ramp 474 leads from first platform 466 to a second platform 481. Provided along second platform 481 and up adjacent second ramp 474 is a third abutment wall 485. Third abutment wall 485 includes a substantially linear portion 487 leading to an angled portion that defines a second camming surface 489. Spaced from each of first platform 466 and second platform 481 is a third platform 492 which leads through an angled portion 495 to second base portion 455. Therefore, in accordance with this embodiment of the invention, a multi-tier arrangement is established, including a first tier defined by base portion 454, a second tier defined by first platform 466 and a third tier defined by second platform 481. In addition, first ramp 463 interconnects the first and second tiers, while second ramp 474 interconnects the second and third tiers. With this arrangement, a guided path is established for terminal end portion 345 of retainer element 330 during movement of upper dish rack 16 between raised and lowered positions as will now be described in detail.

Figure 6:
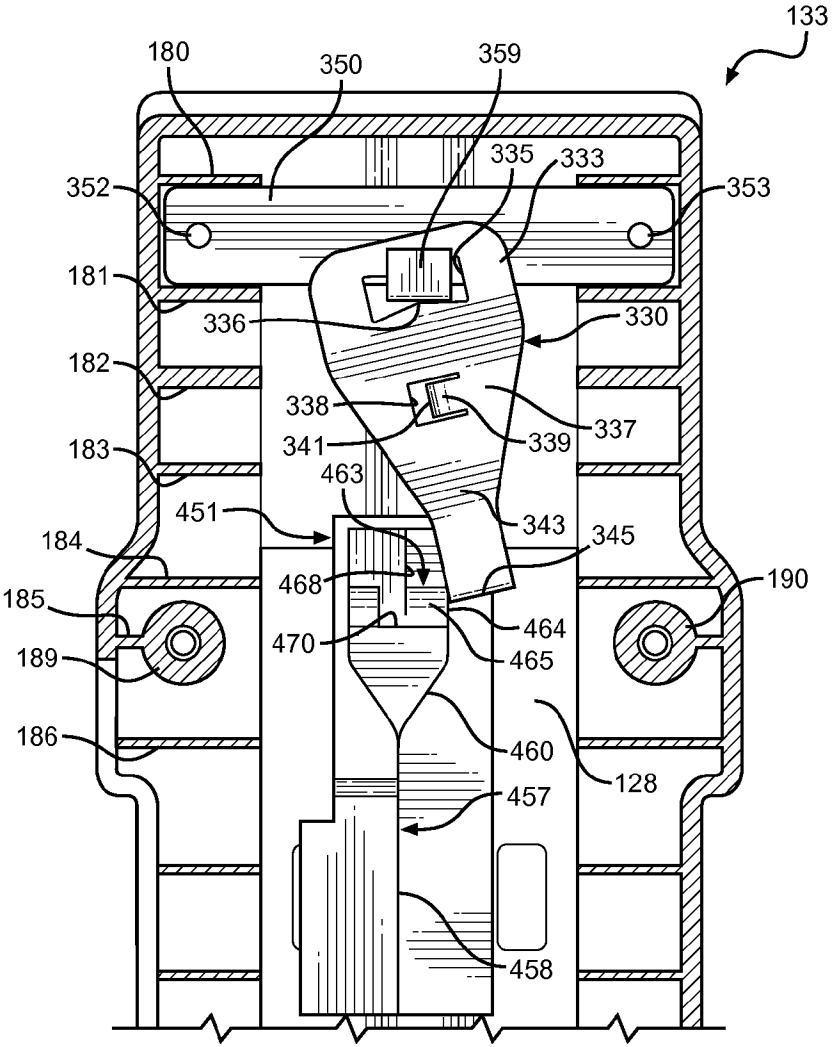
FIGS. 6-10 set forth additional views of the height and latching mechanisms of the invention, shown through various vertically varying operational positions.
Figure 7:
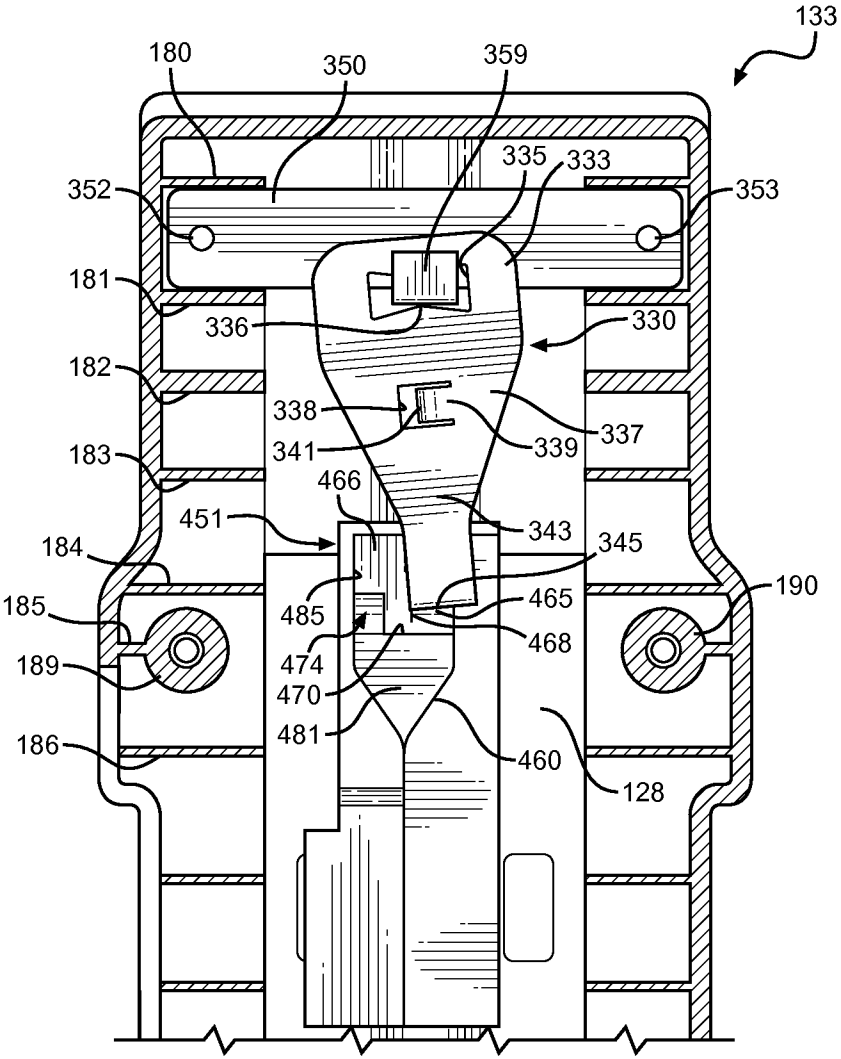

FIG. 4 shows that relative positioning between the various components of this embodiment when upper dish rack 16 is in its lowermost position. More specifically, retainer element 330 is biased by spring 363 such that terminal end portion 345 of tapered section 343 is in engagement with first abutment wall 457. As upper dish rack 16 and support body 133 are raised, preferably by a user manually gripping and lifting dish rack 16, terminal end portion 345, which defines a follower, rides along first camming surface 458, including flared portion 460, until terminal end portion 345 is positioned against tapered side wall 464 of first ramp 463 as shown in FIG. 6. At this point, spring 363 is biasing retainer element 330 to rotate clockwise, but retainer element 330 is prevented from doing so based on its abutment with tapered side wall 464. However, upon slight further raising of support body 133, terminal end portion 345 will shift to a position against second abutment wall 468 of first platform 466 as represented in FIG. 7. As upper dish rack 16 is lowered, terminal end portion 345 is caused to ride along ramp surface 465 of first ramp 463 and become disengaged from second abutment wall 468 in order to assume the position shown in FIG. 8. In this position, terminal end portion 345 rests upon ledge 470 and is prevented from further rotation due to abutment with tapered side wall 477 of second ramp 474. Therefore, FIG. 8 depicts the position of upper dish rack 16 in its fully supported, raised position.

Figure 8:
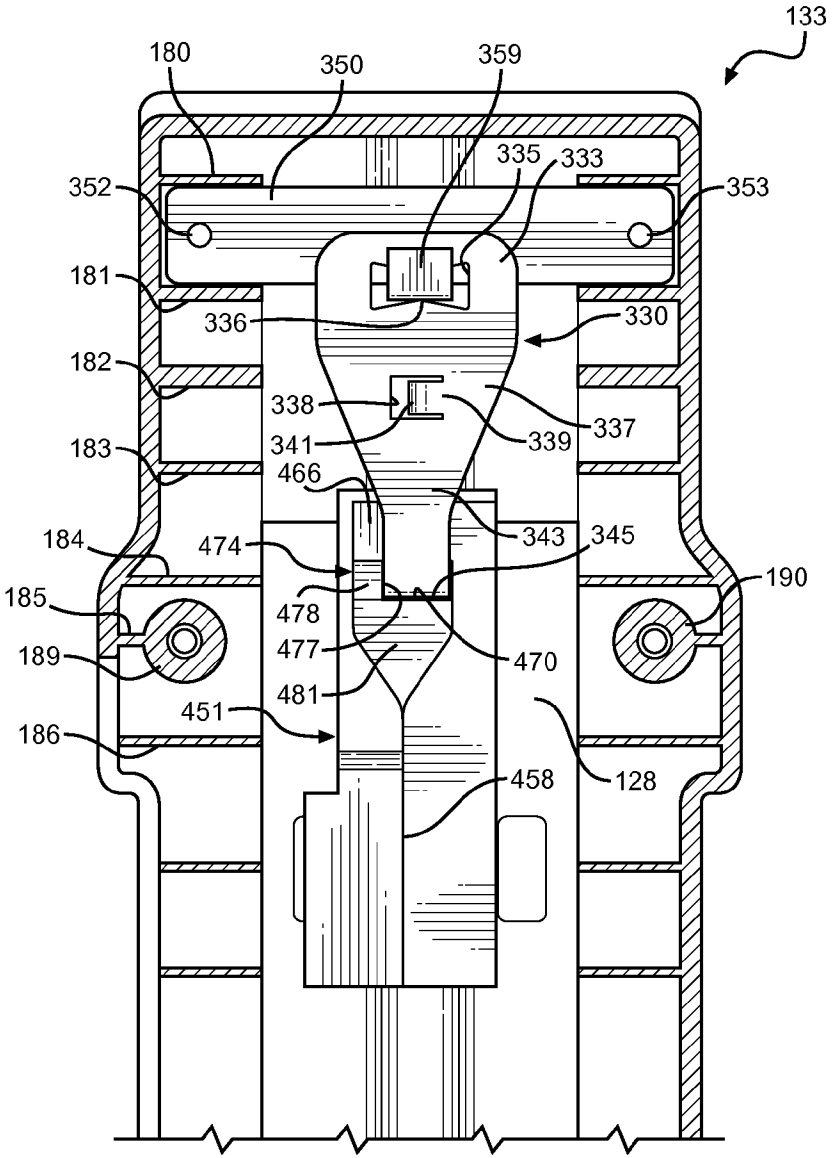
Figure 9:
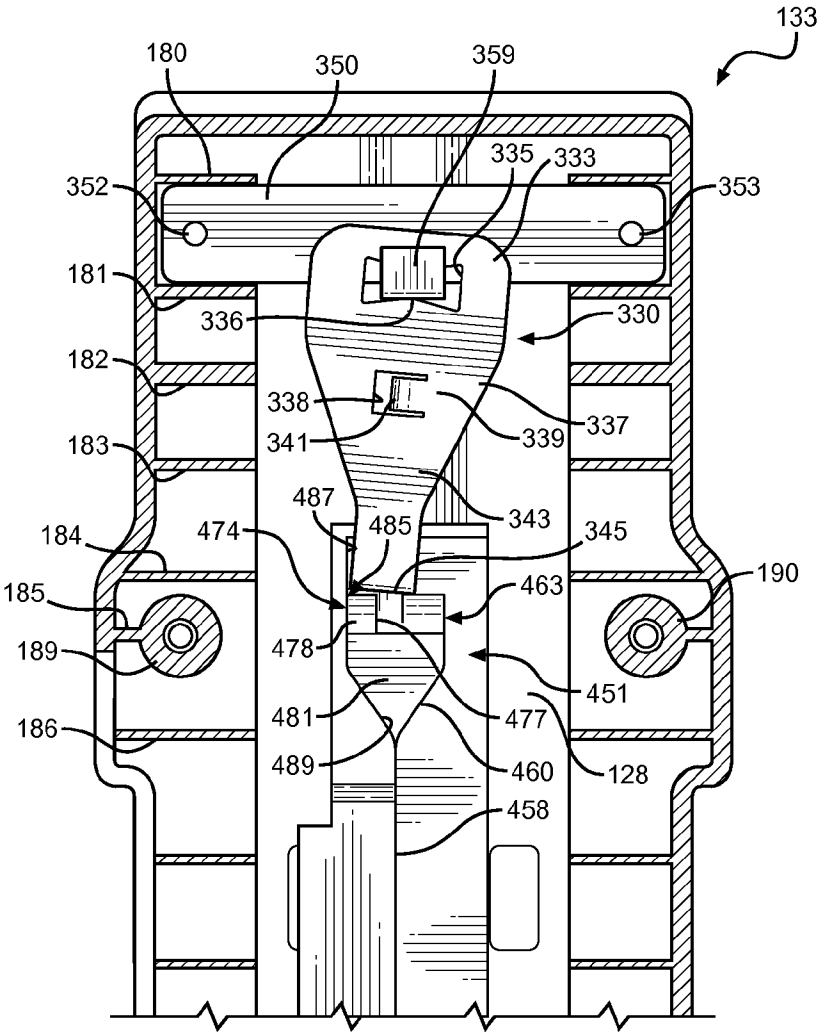
Figure 10:
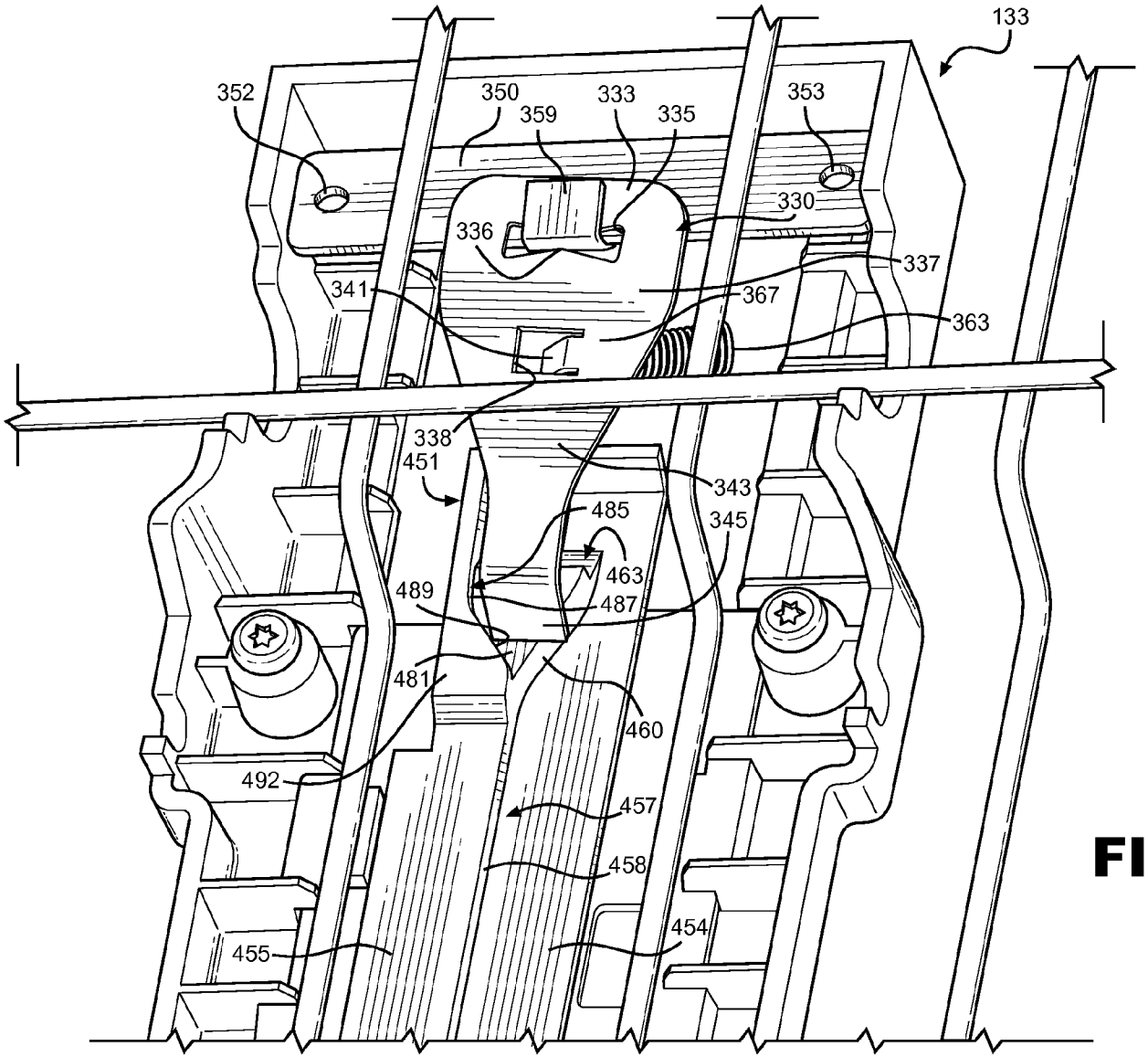

From the position shown in FIG. 8, upper dish rack 16 can be manually lowered, with dish rack 16 being initially raised as shown in FIG. 9 to vertically shift terminal end portion 345 out of engagement with tapered side wall 477, thereby causing terminal end portion 345 to initially assume a position engaging substantially linear portion 487 of third abutment wall 485 then, upon lowering of upper dish rack 16, terminal end portion 345 will be caused to ride along ramp surface 478 of second ramp 474, while being in engagement with third abutment wall 485 as shown in FIG. 10. Continued lowering of upper dish rack 16 will cause terminal end portion 345 to transition from substantially linear portion 347 of third abutment wall 385 to second camming surface 489. Once terminal end portion 345 reaches the end of second camming surface 489, retainer element 330 will be caused to shift due to the biasing force of spring 363 such that terminal end portion 345 will again be in contact with first base portion 454 and first camming surface 458. At this point, upper dish rack 16 can readily assume the lowered position shown in FIG. 4.

Although described with respect to preferred embodiments of the invention, it should be readily understood that various changes and/or modifications can be made to the invention without departing from the spirit thereof. For instance, it would be possible to reverse the retainer element and the camming unit such that the camming unit moves vertically with the rack and the retainer element is pivotally attached to the upright body portion by basically inverting the overall mechanism while still enabling the latching operation to be performed. In addition, although the spring biasing the retainer element operates as a compression spring, it is certainly possible to employ other biasing arrangements, such as utilizing a tension spring provided on an opposing side of the retainer element. Furthermore, other pivoting configurations for the retainer element and cam configurations for the camming unit could be employed. In general, the invention is only intended to be limited by the scope of the following claims.

What is claimed is:

1. A dishwasher comprising:

a tub having top, bottom, rear and side walls that collectively define a washing chamber;

a dish rack in the washing chamber, the dish rack having front, rear, side and bottom walls;

an adjustment mechanism for vertically shifting the dish rack between lowered and raised positions relative to the tub; and a latching mechanism for retaining the dish rack in at least the raised position, said latching mechanism including a camming unit and a retainer element having a follower, said camming unit including multiple tiers on which the follower rides and a ledge, with the multiple tiers being located at different lateral distances relative to the side walls of the dish rack, said camming unit being configured to guide the follower along the multiple tiers upon shifting of the dish rack between the lowered and raised positions, wherein the follower is supported on the ledge when the dish rack is in the raised position, and wherein the follower moves in three different dimensions relative to the dish rack upon shifting of the dish rack between the lowered and raised positions.

2. The dishwasher according to claim 1, wherein said adjustment mechanism includes a base member having a lower body portion, an upper body portion and a shiftable support body secured to the rack and mounted to the upper body portion of the base member for vertical movement relative to both the upper body portion and the tub, the shiftable support body including an outer body member and an inner body member, said upper body portion of the base member being sandwiched between the outer and inner body members.

3. The dishwasher according to claim 2, wherein the latching mechanism is arranged between the outer and inner body members of the shiftable support body.

4. The dishwasher according to claim 3, wherein the latching mechanism operates between the base member and the shiftable support body.

5. The dishwasher according to claim 1, wherein the ledge is between the multiple tiers.

6. The dishwasher according to claim 5, wherein the camming unit includes a base portion defining a first tier of the multiple tiers, a first platform defining a second tier and a third platform defining a third tier, said follower traversing each of the first, second and third tiers in moving the dish rack from one of the raised and lowered positions to the other of the raised and lowered positions, and back.

7. The dishwasher according to claim 6, wherein the ledge is located between the second and third tiers.

8. The dishwasher according to claim 6, further comprising a first ramp leading from the first tier to the second tier.

9. The dishwasher according to claim 8, further comprising a second ramp leading from the second tier to the third tier.

10. The dishwasher according to claim 1, wherein the follower is configured to move both about a pivot axis and orthogonal to the pivot axis.

11. The dishwasher according to claim 10, further comprising a spring biasing the follower against the camming unit.

12. The dishwasher according to claim 1, wherein the camming unit includes a first camming surface leading to a ledge, said retainer element being guided along the first camming surface when the dish rack is shifted from the lowered position to the raised position and supported by the ledge to selectively retain the dish rack in the raised position.

13. A method of vertically adjusting a dish rack supported for selective vertical movement within a dishwasher, the dishwasher including a tub having top, bottom, rear and side walls that collectively define a washing chamber, an adjustment mechanism for vertically shifting the dish rack between lowered and raised positions relative to the tub and a latching mechanism for retaining the dish rack in at least the raised position, the dish rack located in the washing chamber and having front, rear, side and bottom walls, and the latching mechanism having a camming unit and a retainer element having a follower, the method comprising:

guiding the follower of the retainer element along multiple tiers of the camming unit such that the follower moves in three different dimensions relative to the dish rack upon moving the dish rack between the lowered and raised positions, with the multiple tiers being located at different lateral distances relative to the side walls of the dish rack; and supporting the follower on a ledge of the camming unit when the dish rack is in the raised position.

14. The method of claim 13, further comprising, when adjusting the dish rack from the lowered position to the raised position, guiding the follower over a first ramp leading from a first tier to a second tier of the multiple tiers.

15. The method of claim 14, further comprising, when adjusting the dish rack from the raised position to the lowered position, guiding the follower from the second tier over a second ramp leading from the second tier to a third tier of the multiple tiers.

16. The method of claim 15, further comprising, when adjusting the dish rack from the raised position to the lowered position, further guiding the follower directly from the third tier to the first tier.

17. The method of claim 13, further comprising: raising the dish rack from the lowered position to the raised position by manually lifting the dish rack to cause the follower of the retainer element to be shifted about a pivot axis while being biased against a first camming surface and then to shift in a direction of a biasing force in order to reach a ledge upon which the retainer element can be supported to retain the dish rack in the raised position.

18. The method of claim 17, further comprising: lowering the dish rack from the raised position to the lowered position by initially, manually lifting the dish rack until the retainer element shifts in the direction of the biasing force and then fully lowering the dish rack, during which the follower shifts about both a pivot axis and orthogonal to the pivot axis.

19. The method of claim 13, further comprising: continuously biasing the follower against the camming unit.

20. The method of claim 13, further comprising: moving the follower both about a pivot axis and orthogonal to the pivot axis when moving the dish rack between the lowered and raised positions.

* * * * *